US006405523B1

(12) United States Patent
Foust et al.

(10) Patent No.: US 6,405,523 B1
(45) Date of Patent: Jun. 18, 2002

(54) METHOD AND APPARATUS FOR DECREASING COMBUSTOR EMISSIONS

(75) Inventors: Michael Jerome Foust; Hukam Chand Mongia, both of West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/675,667

(22) Filed: Sep. 29, 2000

(51) Int. Cl.[7] ..... F02C 7/26
(52) U.S. Cl. ..... 60/39.06; 60/748
(58) Field of Search ..... 60/746, 747, 748, 60/39.06

(56) References Cited

U.S. PATENT DOCUMENTS

| | | | | |
|---|---|---|---|---|
| 4,567,857 A | | 2/1986 | Houseman et al. | |
| 5,323,604 A | | 6/1994 | Ekstedt et al. | |
| 5,584,178 A | | 12/1996 | Naegeli et al. | |
| 5,590,529 A | | 1/1997 | Joshi et al. | |
| 5,613,363 A | | 3/1997 | Joshi et al. | |
| 5,623,827 A | * | 4/1997 | Monty | 60/748 |
| 5,970,715 A | | 10/1999 | Narang | |
| 6,070,410 A | | 6/2000 | Dean | |
| 6,082,111 A | * | 7/2000 | Stokes | 60/737 |
| 6,192,688 B1 | | 2/2001 | Beebe | |
| 6,195,607 B1 | | 2/2001 | Rajamani et al. | |

* cited by examiner

*Primary Examiner*—Charles G. Freay
*Assistant Examiner*—Ehud Gartenberg
(74) *Attorney, Agent, or Firm*—William Scott Andes Armstrong Teasdale LLP

(57) ABSTRACT

A combustor for a gas turbine engine operates with low nitrous oxide emissions during engine operations. The combustor includes a center mixer assembly and a second mixer assembly radially outward from the center mixer assembly. The center mixer assembly includes a pilot fuel injector, a swirler, and an air splitter, and the second mixer assembly includes a plurality of mixers that include a swirler, an atomizer, and a venturi. A combustor fuel delivery system includes a pilot fuel circuit to supply fuel to the center mixer assembly and a main fuel circuit to supply fuel to the second mixer assembly.

20 Claims, 3 Drawing Sheets

METHOD AND APPARATUS FOR DECREASING COMBUSTOR EMISSIONS

BACKGROUND OF THE INVENTION

This application relates generally to combustors and, more particularly, to gas turbine combustors.

Air pollution concerns worldwide have led to stricter emissions standards both domestically and internationally. Aircraft are governed by both Environmental Protection Agency (EPA) and International Civil Aviation Organization (ICAO) standards. These standards regulate the emission of oxides of nitrogen (NOx), unburned hydrocarbons (HC), and carbon monoxide (CO) from aircraft in the vicinity of airports, where they contribute to urban photochemical smog problems. Most aircraft engines are able to meet current emission standards using combustor technologies and theories proven over the past 50 years of engine development. However, with the advent of greater environmental concern worldwide, there is no guarantee that future emissions standards will be within the capability of current combustor technologies.

In general, engine emissions fall into two classes: those formed because of high flame temperatures (NOx), and those formed because of low flame temperatures which do not allow the fuel-air reaction to proceed to completion (HC & CO). A small window exists where both pollutants are minimized. For this window to be effective, however, the reactants must be well mixed, so that burning occurs evenly across the mixture without hot spots, where NOx is produced, or cold spots, when CO and HC are produced. Hot spots are produced where the mixture of fuel and air is near a specific ratio when all fuel and air react (i.e. no unburned fuel or air is present in the products). This mixture is called stoichiometric. Cold spots can occur if either excess air is present (called lean combustion), or if excess fuel is present (called rich combustion).

Modern gas turbine combustors consist of between 10 and 30 mixers, which mix high velocity air with a fine fuel spray. These mixers usually consist of a single fuel injector located at a center of a swrirler for swirling the incoming air to enhance flame stabilization and mixing. Both the fuel injector and mixer are located on a combustor dome.

In general, the fuel to air ratio in the mixer is rich. Since the overall combustor fuel-air ratio of gas turbine combustors is lean, additional air is added through discrete dilution holes prior to exiting the combustor. Poor mixing and hot spots can occur both at the dome, where the injected fuel must vaporize and mix prior to burning, and in the vicinity of the dilution holes, where air is added to the rich dome mixter Properly designed, rich dome combustors are very stable devices with wide flammability limits and can produce low HC and CO emissions, and acceptable NOx emissions. However, a fundamental limitation on rich dome combustors exists, since the rich dome mixture must pass through stoichiometric or maximum NOx producing regions prior to exiting the combustor. This is particularly important because as the operating pressure ratio (OPR) of moder gas turbines increases for improved cycle efficiencies and compactness, combustor inlet temperatures and pressures increase the rate of NOx production dramatically. As emission standards become more stringent and OPR's increase, it appears unlikely that traditional rich dome combustors will be able to meet the challenge.

One state-of-the-art lean dome combustor is referred to as a dual annular combustor (DAC) because it includes two radially stacked mixers on each fuel nozzle which appear as two annular rings when viewed from the front of a combustor. The additional row of mixers allows tuning for operation at different conditions. At idle, the outer mixer is fueled, which is designed to operate efficiently at idle conditions. At high power operation, both mixers are fueled with the majority of fuel and air supplied to the inner annulus, which is designed to operate most efficiently and with few emissions at high power operation. While the mixers have been tuned for optimal operation with each dome, the boundary between the domes quenches the CO reaction over a large region, which makes the CO of these designs higher than similar rich dome single annular combustors (SACs). Such a combustor is a compromise between low power emissions and high power NOx.

Other known designs alleviate the problems discussed above with the use of a lean dome combustor. Instead of separating the pilot and main stages in separate domes and creating a significant CO quench zone at the interface, the mixer incorporates concentric, but distinct pilot and main air streams within the device. However, the simultaneous control of low power CO/HC and smoke emission is difficult with such designs because increasing the fuel/air mixing often results in high CO/HC emissions. The swirling main air naturally tends to entrain the pilot flame and quench it. To prevent the fuel spray from getting entrained into the main air, the pilot establishes a narrow angle spray. This results in a long jet flames characteristic of a low swirl number flow. Such pilot flames produce high smoke, carbon monoxide, and hydrocarbon emissions and have poor stability.

BRIEF SUMMARY OF THE INVENTION

In an exemplary embodiment, a combustor for a gas turbine engine operates with high combustion efficiency and low carbon monoxide, nitrous oxide, and smoke emissions during low, intermediate, and high engine power operations. The combustor includes a center mixer assembly and a second mixer assembly radially outward from the center mixer assembly. The center mixer assembly includes a pilot fuel injector, at least one swirler, and an air splitter. The second mixer assembly is circumferentially outward from the center mixer assembly and includes a plurality of mixers that include a swirler, an atomizer, and a venturi. The combustor also includes a fuel delivery system including a pilot fuel circuit that supplies fuel to the center mixer assembly and a main fuel circuit that includes at least two fuel stages to supply fuel to the second mixer assembly.

During low power operation, the center mixer assembly aerodynamically isolates a pilot flame from a main stage of air. Under engine idle power operation, the combustor injects fuel only through the pilot fuel circuit directly into the center mixer assembly while channeling air through the second mixer assembly. Because the combustor operates using only the pilot fuel circuit during idle power operations, a high combustor idle power operating efficiency is maintained and combustor emissions are controlled. Under increased power operating conditions, fuel is injected through both the pilot and main fuel circuits. The fuel is dispersed evenly throughout the combustor to maintain control of emissions generated during increased power operations. As a result, a combustor is provided which operates with a high combustion efficiency while controlling and maintaining low carbon monoxide, nitrous oxide, and smoke emissions during engine low, intermediate, and high power operations.

DETAILED DESCRIPTION OF THE INVENTION

Figure 1:
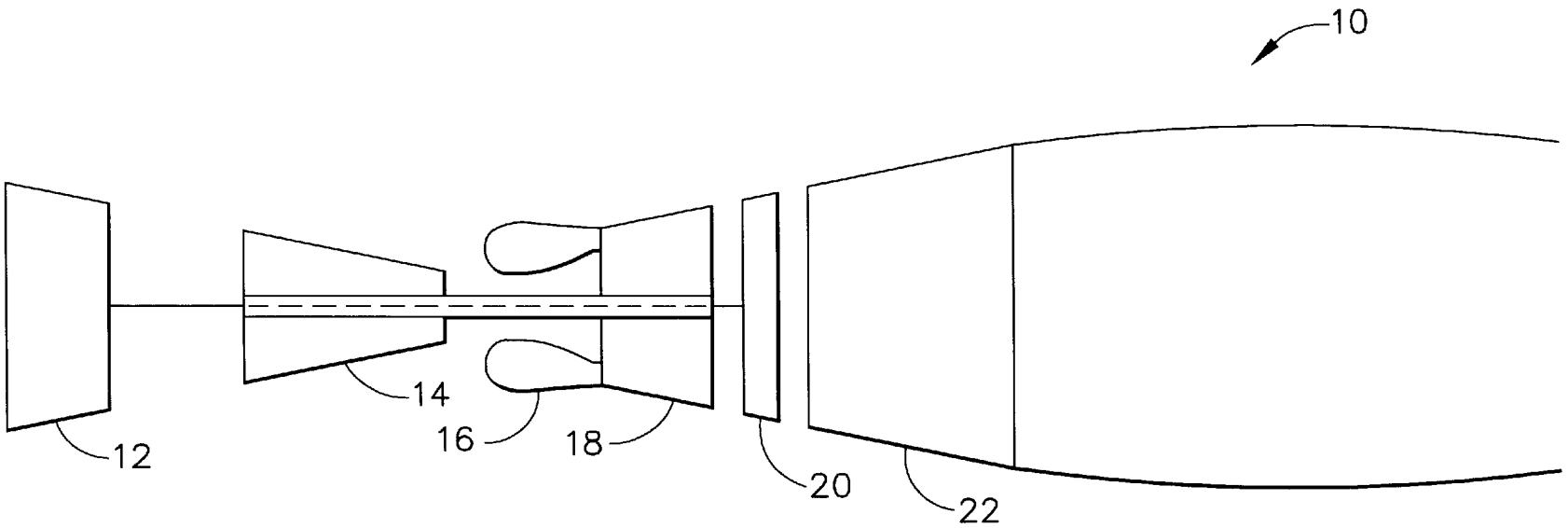
FIG. 1 is schematic illustration of a gas turbine engine including a combustor.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20.

In operation, air flows through low pressure compressor 12 and compressed air is supplied from low pressure compressor 12 to high pressure compressor 14. The highly compressed air is delivered to combustor 16. Airflow (not shown in FIG. 1) from combustor 16 drives turbines 18 and 20.

Figure 2:
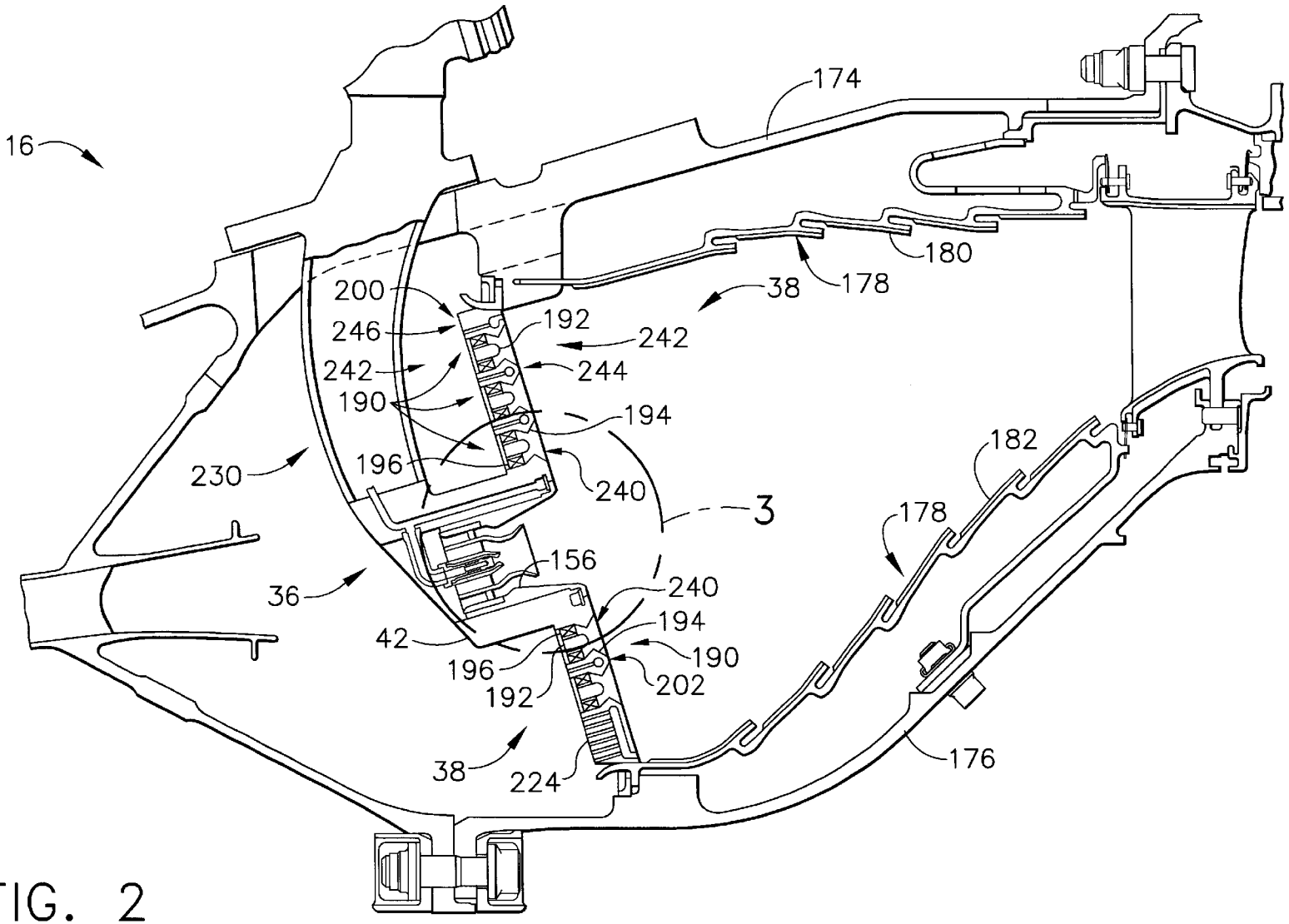
FIG. 2 is a cross-sectional view of a combustor used with the gas turbine engine shown in FIG. 1.
Figure 3:
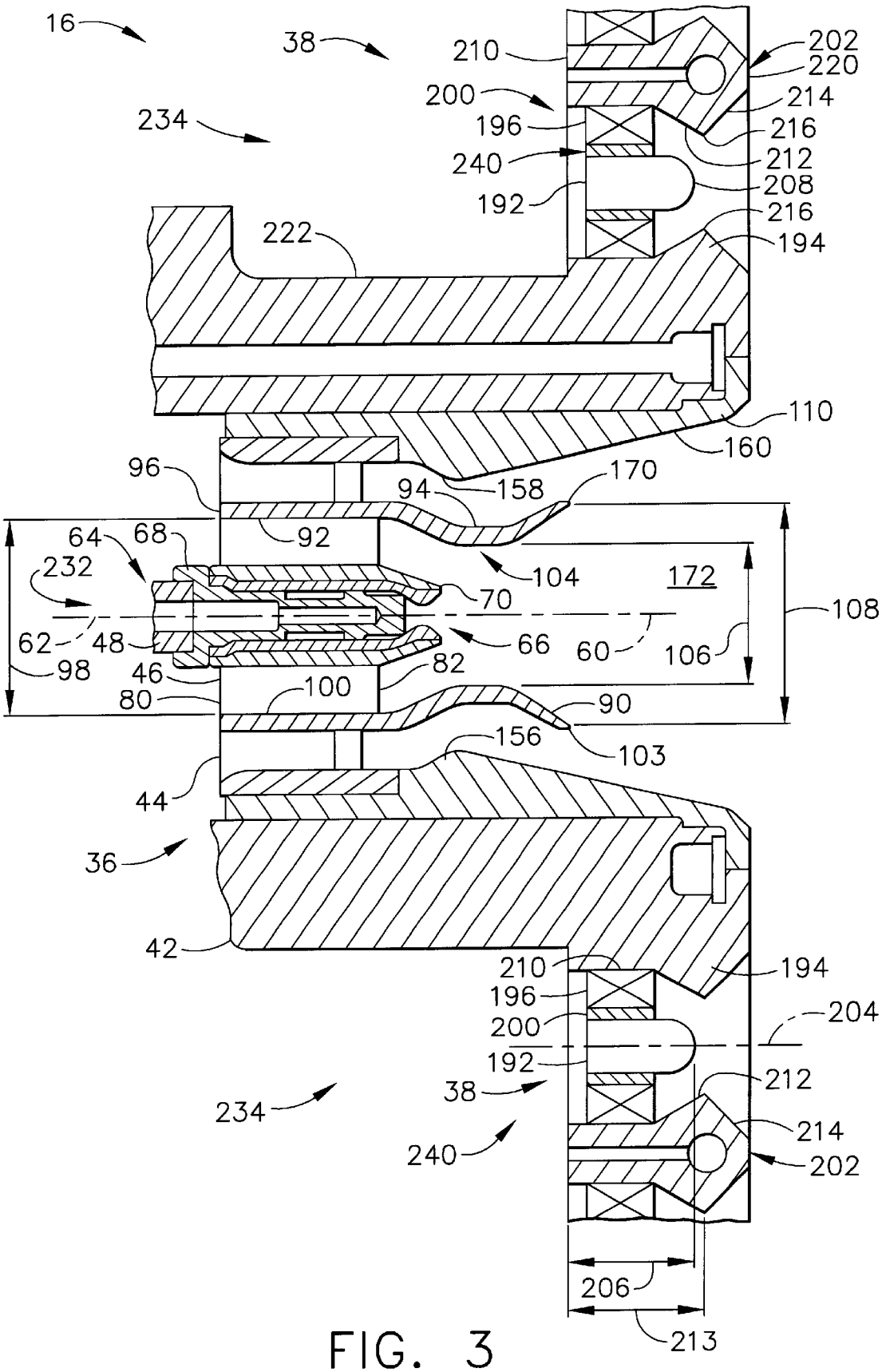
FIG. 3 is an enlarged view of the combustor of FIG. 2 taken along area 3.

FIG. 2 is a cross-sectional view of combustor 16 for use with a gas turbine engine, similar to engine 10 shown in FIG. 1, and FIG. 3 is an enlarged view of combustor 16 taken along area 3. In one embodiment, the gas turbine engine is a CFM engine available from CFM International. In another embodiment, the gas turbine engine is a GE90 engine available from General Electric Company, Cincinnati, Ohio. Combustor 16 includes a center mixer assembly 36 and a second mixer assembly 38 disposed radially outward from center mixer assembly 36.

Center mixer assembly 36 includes an outer wall 42, a pilot outer swirler 44, a pilot inner swirler 46, and a pilot fuel injector 48. Center mixer assembly 36 has an axis of symmetry 60, and is generally cylindrical-shaped with an annular cross-sectional profile (not shown). An inner flame (not shown), sometimes referred to as a pilot, is a spray diffusion flame fueled entirely from gas turbine start conditions. In one embodiment, pilot fuel injector 48 supplies fuel through injection jets (not shown). In an alternative embodiment, pilot fuel injector 48 supplies fuel through injection simplex sprays (not shown)

Pilot fuel injector 48 includes an axis of symmetry 62 and is positioned within center mixer assembly 36 such that fuel injector axis of symmetry 62 is substantially co-axial with center mixer assembly axis of symmetry 60. Fuel injector 48 injects fuel to the pilot and includes an intake side 64, a discharge side 66, and a body 68 extending between intake side 64 and discharge side 66. Discharge side 66 includes a convergent discharge nozzle 70 which directs a fuel-flow (not shown) outward from fuel injector 48 substantially parallel to center mixer assembly axis of symmetry 60.

Pilot inner swirler 46 is annular and is circumferentially disposed around pilot fuel injector 48. Pilot inner swirler 46 includes an intake side 80 and an outlet side 82. An inner pilot airflow stream (not shown) enters pilot inner swirler intake side 80 and is accelerated prior to exiting through pilot inner swirler outlet side 82.

A baseline air blast pilot splitter 90 is positioned downstream from pilot inner swirle 46. Baseline air blast pilot splitter 90 includes an upstream portion 92 and a downstream portion 94 extending from upstream portion 92. Upstream portion 92 includes a leading edge 96 and has a diameter 98 that is constant from leading edge 96 to air blast pilot splitter downstream portion 94. Upstream portion 92 also includes an inner surface 100 positioned substantially parallel and adjacent pilot inner swirler 46.

Baseline air blast pilot splitter downstream portion 94 extends from upstream portion 92 to a trailing edge 103 of splitter 90. Downstream portion 94 is convergent towards center mixer assembly axis of symmetry 60 such at a mid-point 104 of downstream portion 94, downstream portion 94 has a diameter 106 that is less than upstream portion diameter 98. Downstream portion 94 diverges outward from downstream portion mid-point 104 such that trailing edge diameter 108 is larger than downstream portion mid-point diameter 106, but less than upstream portion diameter 98.

Pilot outer swirler 44 extends substantially perpendicularly from baseline air blast pilot splitter 90 and attaches to a contoured wall 110. Contoured wall 110 is attached to center mixer assembly outer wall 42. Pilot outer swirler 44 is annular and is circumferentially disposed around baseline air blast pilot splitter 90. Contoured wall 110 includes an apex 156 positioned between a convergent section 158 of contoured wall 110 and a divergent section 160 of contoured wall 110. Splitter downstream portion 94 diverges towards contoured wall divergent section 160.

Contoured wall 110 also includes a trailing edge 170 that extends from contoured wall divergent section 160. Trailing edge 170 is substantially perpendicular to center mixer assembly axis of symmetry 60 and is adjacent a combustion zone 172. Combustion zone 172 is formed by annular, radially outer and radially inner casing support members 174 and 176, respectively, and a combustor liner 178, respectively. Combustor liner 178 shields the outer and inner support members 174 and 176, respectively, from the heat generated within combustion zone 172 and includes an outer liner 180 and an inner liner 182. Outer liner 180 and inner liner 182 are annular and define combustion zone 172.

Second mixer assembly 38 is radially outward from center mixer assembly 36 and extends circumferentially around center mixer assembly 36. In one embodiment, second mixer assembly 38 is known as an Affordable Multiple Venturi (AMV). Second mixer assembly 38 includes a concentric array of mixers 190 positioned radially outward from center mixer assembly 36. In one embodiment, combustor 16 includes three annular arrays of mixers 190 positioned between center mixer assembly 36 and combustion outer liner 180 and two annular arrays of mixers 190 positioned between center mixer assembly 36 and combustion inner liner 182.

Each mixer 190 includes an atomizer 192, a venturi 194, and a swirler 196. Mixer 190 has a leading edge 200, a trailing edge 202, and an axis of symmetry 204. Mixers 190 are positioned such that leading edges 200 are substantially co-planar and such that trailing edges 202 are also substantially co-planar. Additionally, mixer trailing edges 202 are substantially co-planar with center mixer assembly contoured wall trailing edge 170.

Each atomizer 192 has a length 206 extending between second mixer assembly leading edge 200 to a tip 208 of atomizer 192. Each atomizer 192 is positioned co-axially with respect to mixer assembly axis of symmetry 204 within each mixer assembly 38. In one embodiment, atomizers 192 are annular airblast simplex atomizers. Atomizers 192 are annular and are in flow communication with a fuel source (not shown). As fuel is supplied to second mixer assembly 38, atomizers 192 atomize the fuel prior to the atomized fuel entering combustion chamber 172.

Swirlers 196 are annular and are radially outward from atomizers 192. In one embodiment, swirlers 192 are single axial swirlers. In an alternative embodiment, swirlers 192 are radial swirlers. Swirlers 196 cause air flowing through second mixer assembly 38 to swirl to assist atomizers 192 in atomizing fuel and to cause fuel and air to mix thoroughly prior to entering combustion chamber 172. In one embodiment, swirlers 196 induce airflow to swirl in a counter-clockwise direction. In another embodiment, swirlers 196 induce airflow to swirl in a clockwise direction. In yet another embodiment, swirlers 196 induce airflow to swirl in counter-clockwise and clockwise directions.

Venturis 194 are annular and are radially outward from swirlers 196. Venturis 194 include a planar section 210, a converging section 212, and a diverging section 214. Planar section 210 is radially outward from and adjacent swirlers 196. Converging section 212 extends radially inward from planar section 210 to a venturi apex 216. Diverging section 214 extends radially outward from venturi apex 216 to a trailing edge 220 of venturi 194. In an alternative embodiment, venturi 194 only includes converging section 212 and does not include diverging section 214.

Venturi apex 216 is located a distance 213 from second mixing assembly leading edge 200. Distance 213 is approximately equal atomizer length 206 such that each venturi apex 216 is in close proximity to atomizer tip 208. Accordingly, venturi converging section 212 directs airflow towards atomizer tip 208 to assist atomizer 192 in atomizing fuel and to ensure fuel and air mix thoroughly. Venturis 194 located adjacent center mixer assembly 36 extend from an outer surface 222 of outer wall 42.

A fuel delivery system 230 supplies fuel to combustor 16 and includes a pilot fuel circuit 232 and a main fuel circuit 234. Pilot fuel circuit 232 supplies fuel to pilot fuel injector 48 and main fuel circuit 234 supplies fuel to second mixer assembly 38 and includes three independent fuel stages used to control nitrous oxide emissions generated within combustor 16.

Mixers 190 located adjacent center mixer assembly 36 are radially inner mixers or first fuel stage mixers 240 and are supplied fuel during a first fuel stages. Mixers 190 located between radially inner mixers and combustor liner 178 are radially outer mixers 242 and are supplied fuel during second and third fuel stages. More specifically, mixers 190 located adjacent first fuel stage mixers 240 are second fuel stage mixers 244 and second mixer assemblies 38 located between second fuel stage mixers 244 and combustor liner 178 are third stage fuel mixers 246.

In operation, as gas turbine engine 10 is started and operated at idle operating conditions, fuel and air are supplied to combustor 16. During gas turbine idle operating conditions, combustor 16 uses only center mixer assembly 36 for operating. Pilot fuel circuit 232 injects fuel to combustor 16 through pilot fuel injector 48. Simultaneously, airflow enters pilot swirler intake 80 and is accelerated outward from pilot swirler outlet side 82 and additional airflow enters second mixer assembly 38 through swirlers 196. The pilot airflow flows substantially parallel to center mixer axis of symmetry 60 and strikes air splitter 90 which directs the pilot airflow in a swirling motion towards fuel exiting pilot fuel injector 48. The pilot airflow does not collapse a spray pattern (not shown) of pilot fuel injector 48, but instead stablizes and atomizes the fuel. The second mixer assembly airflow is directed through venturis 194 into combustion chamber 172.

Utilizing only the pilot fuel stage permits combustor 16 to maintain low power operating efficiency and to control and minimize emissions exiting combustor 16. Because the pilot airflow is separated from the second mixer assembly airflow, the pilot fuel is completely ignited and burned, resulting in lean stability and low power emissions of carbon monoxide, hydrocarbons, and nitrous oxide.

As gas turbine engine 10 is accelerated from idle operating conditions to increased power operating conditions, additional fuel and air are directed into combustor 16. In addition to the pilot fuel stage, during increased power operating conditions, second mixer assembly 38 is supplied fuel with main fuel circuit 234. Initially, as power operating conditions are increased, the first fuel stage supplies fuel to first fuel stage mixers 240. Air flowing through second mixer assembly 38 and passing through first fuel stage mixer swirlers 196 and venturis 194 assists first fuel stage mixer atomizers 192 in atomizing the fuel.

As gas turbine engine 10 is further accelerated, fuel is supplied to second stage mixers 244 until gas turbine engine 10 reaches high power operations. During high power operations, fuel is supplied to only third stage fuel mixers 246. In an alternative embodiment, main fuel circuit 234 includes only two independent fuel stages used to control nitrous oxide emissions generated within combustor and the second fuel stage supplies fuel to both second stage mixers 244 and third stage mixers 246. Venturis 194 ensure that fuel and air are rapidly mixed before burning in combustion zone 172. As a result, combustion within combustion chamber 172 is improved and emissions are reduced. Furthermore, because the combustion is improved and because second mixer assembly 38 distributes the fuel evenly throughout combustor 16, flame temperatures are reduced, thus reducing an amount of nitrous oxide produced within combustor 16.

The above-described combustor is cost-effective and highly reliable. The combustor includes a center mixer assembly that is used during lower power operations and a second mixer assembly used during mid and high power operations. The center mixer assembly includes an air splitter and the second mixer assembly includes a plurality of mixers, atomizers, and venturis that are supplied fuel during at least two independent fuel stages. During idle power operating conditions, the combustor operates with low emissions and supplies fuel to only uses the center mixer assembly. During increased power operating conditions, the combustor also supplies fuel to the second mixer assembly to improve combustion and lower the overall flame temperature within the combustor. As a result of the lower temperatures and improved combustion, the combustor provides a high operating efficiency and decreased emissions compared to known combustors. Thus, a combustor is provided which operates at a high combustion efficiency and with low carbon monoxide, nitrous oxide, and smoke emissions.

While the invention has been described in terms of various specific embodiments, those skilled in the art will recognize that the invention can be practiced with modification within the spirit and scope of the claims.

What is claimed is:

1. A method for reducing an amount of emissions from a gas turbine combustor using a mixer assembly, the mixer assembly including a center mixer and a plurality of second mixers, the center mixer radially inward from the plurality of second mixers and including an air splitter, each of the second mixers including an atomizer, a swirler, and a venturi, the swirler upstream from the venturi, the swirler radially outward from the atomizer, said method comprising the steps of:

injecting fuel into the combustor using a fuel system that includes at least two fuel stages; and directing airflow into the combustor such that a portion of the airflow passes through the center mixer air assembly and a portion of the airflow passes through the second mixers.

2. A method in accordance with claim 1 wherein the fuel system includes a pilot fuel stage and a main fuel stage, the pilot fuel stage radially inward from the main fuel stage and including a fuel injector, said step of injecting fuel further comprising the step of injecting fuel into the combustor pilot fuel injector.

3. A method in accordance with claim 2 wherein said step of directing airflow further comprises the step of directing airflow to enter the plurality of second mixers downstream from the combustor pilot fuel injector.

4. A method in accordance with claim 1 wherein the fuel system includes a pilot fuel stage and a main fuel stage, the pilot fuel stage including a fuel injector and disposed within the center mixer, radially inward from the main fuel stage, said step of injecting fuel further comprises the step of injecting fuel through the center mixer with the combustor main fuel stage.

5. A method in accordance with claim 1 wherein said step of directing airflow further comprises the step of directing airflow through a second mixer converging venturi downstream from the air splitter.

6. A method in accordance with claim 1 wherein said step of directing airflow further comprises the step of directing airflow through a second mixer converging-diverging venturi downstream from the air splitter.

7. A combustor for a gas turbine comprising:

a center mixer assembly comprising an air splitter;

a plurality of second mixer assemblies radially outward from said center mixer assembly, each of said plurality of second mixer assemblies comprises an atomizer, a swirler, and a venturi, said swirler upstream from said venturi, said atomizer radially inward from swirler; and a fuel system comprising at least two fuel stages, said fuel delivery system configured to supply fuel to said combustor through said center mixer assembly.

8. A combustor in accordance with claim 7 wherein said at least two fuel stages comprise a pilot fuel stage and a main fuel stage, said pilot fuel stage radially inward from said main fuel stage.

9. A combustor in accordance with claim 8 wherein said pilot fuel stage comprises a fuel injector, said dome air splitter radially outward from said pilot fuel injector, said plurality of second mixer assemblies downstream from said fuel injector.

10. A combustor in accordance with claim 7 wherein said venturi comprises a converging venturi.

11. A combustor in accordance with claim 7 wherein said venturi comprises a converging-diverging venturi.

12. A combustor in accordance with claim 7 wherein said plurality of second mixer assemblies further comprise radially inner mixer assemblies and radially outer mixer assemblies, said radially inner mixer assemblies radially inward from said radially outer mixer assemblies, said at least two fuel stages comprise a pilot fuel stage and a main fuel stage, said pilot fuel stage radially inward from said main fuel stage.

13. A combustor in accordance with claim 12 wherein said pilot fuel circuit comprises a fuel injector disposed within said center mixer assembly, said pilot fuel stage configured to supply fuel to said combustor through said fuel injector, said main fuel stage configured to supply fuel to said combustor through at least one of said radially inner mixer assemblies and said radially outer mixer assemblies.

14. A combustor in accordance with claim 13 wherein said main fuel stage configured to supply fuel to said radially inner mixer assemblies and said radially outer mixer assemblies, said atomizer is an airblast simplex atomizer.

15. A mixer assembly for a combustor, said mixer assembly configured to control emissions from the combustor and comprising a center mixer and a plurality of second mixers circumferentially outward from the combustor center mixer, said center mixer comprising an air splitter, each of said second mixers comprising an atomizer, a swirler, and a venturi, said swirler upstream from said venturi, said atomizer radially inward from said swirler.

16. A mixer assembly in accordance with claim 15 wherein said plurality of second mixers further comprise radially outer mixers and radially inner mixers, said radially outer mixers radially outward from said radially inner mixers.

17. A mixer assembly in accordance with claim 15 wherein the combustor further includes a fuel system including a pilot fuel stage and a main fuel stage, said second mixers configured to receive fuel supplied by the main fuel stage.

18. A mixer assembly in accordance with claim 15 wherein said atomizer is an airblast simplex atomizer.

19. A mixer assembly in accordance with claim 15 wherein said venturi comprises a converging venturi.

20. A mixer assembly in accordance with claim 15 wherein said venturi comprises a converging-diverging venturi.

* * * * *